United States Patent [19]

Mastalski et al.

[11] 4,327,534

[45] May 4, 1982

[54] METHOD AND APPARATUS FOR EXTENDING THE HEIGHT OF UTILITY POLES

[75] Inventors: Henry Mastalski, Centralia; James T. Odom, Columbia, both of Mo.

[73] Assignee: A. B. Chance Company, Centralia, Mo.

[21] Appl. No.: 163,274

[22] Filed: Jun. 26, 1980

[51] Int. Cl.[3] ..... E04G 23/06; E04H 17/26

[52] U.S. Cl. ..... 52/122; 52/165; 52/170; 52/514; 52/742; 254/30

[58] Field of Search ..... 52/122, 165, 170, 514, 52/742; 254/29 R, 30, 31, 106

[56] References Cited

U.S. PATENT DOCUMENTS

| | | | |
|---|---|---|---|
| 877,268 | 1/1908 | Van Buren | 52/165 |
| 1,461,046 | 7/1923 | Patterson | 52/742 |
| 1,817,342 | 8/1931 | Beecher | 52/170 |
| 2,040,010 | 5/1936 | McMahon | 52/514 X |
| 2,757,903 | 8/1956 | Bill | 254/30 |
| 3,317,185 | 5/1967 | Burk et al. | 254/30 |
| 3,320,714 | 5/1967 | Barrett | 52/170 X |
| 3,355,146 | 11/1967 | Ashworth | 254/29 R |
| 3,734,463 | 5/1973 | Enright | 254/30 |
| 3,738,072 | 6/1973 | Adrian | 52/514 X |
| 3,946,988 | 3/1976 | Kehren | 254/30 |

*Primary Examiner*—Alfred C. Perham

*Attorney, Agent, or Firm*—Schmidt, Johnson, Hovey & Williams

[57] ABSTRACT

A method and apparatus for permanently extending the height of an upright pole set in the ground uses pole reinforcers which are driven in the ground alongside and complemental to the pole. Extensible power devices mounted on ground-engaging supports use gripping heads mounted adjacent the upper end of the device, in such manner that actuation of the devices holds the heads in biting engagement with the pole. As the devices are extended, the heads pull the pole from the ground and through the predetermined channel formed by the pole reinforcers. Once the pole is extended to the desired elevation, the pole reinforcers are permanently secured to the pole to provide stability at the new height. The present invention is useful in moving the pole through extended displacements in a single stroke of the hydraulic cylinders of the devices, obviating the necessity for successive attachment and detachment of the apparatus during raising of the pole.

20 Claims, 11 Drawing Figures

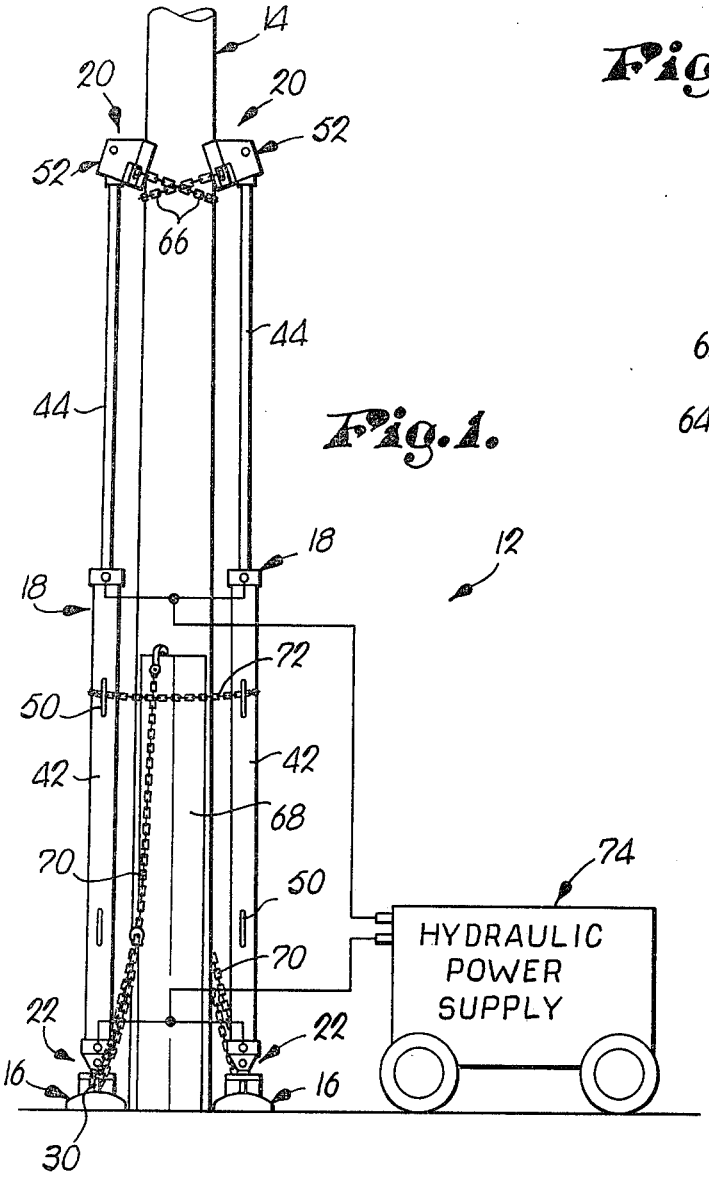
Fig.1.
Fig.3.
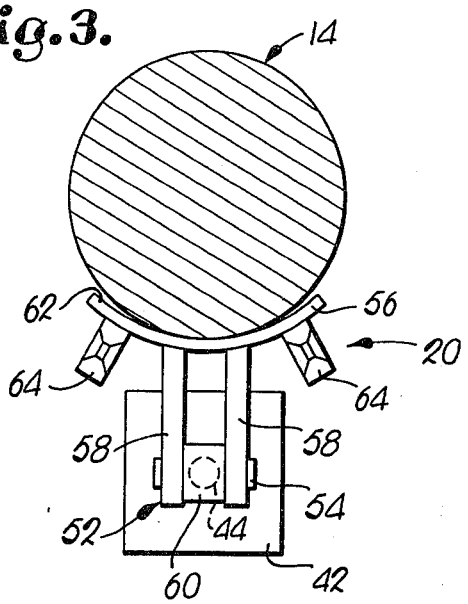
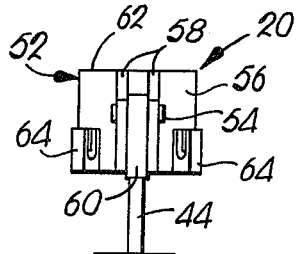
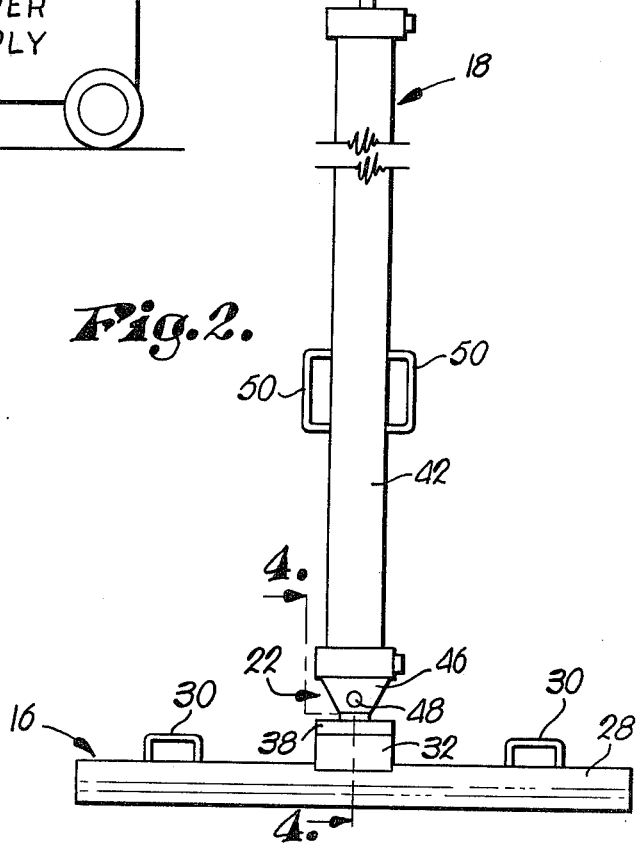
Fig.2.
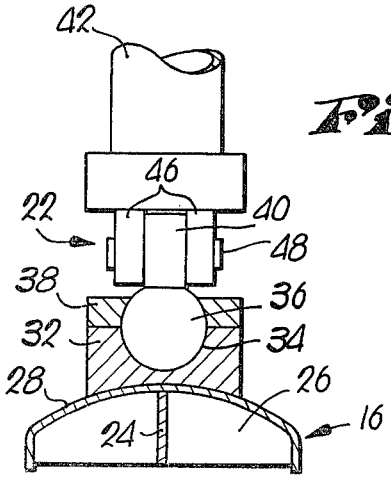
Fig.4.

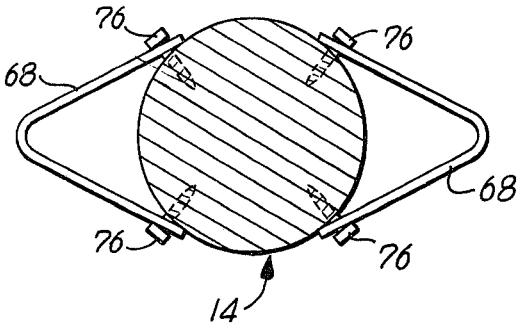
Fig.5.
Fig.6.
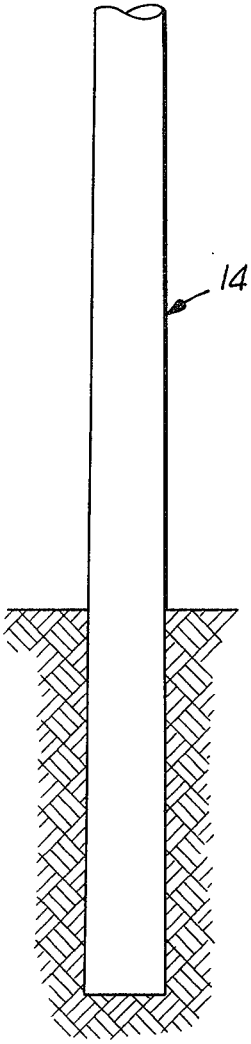
Fig.7.
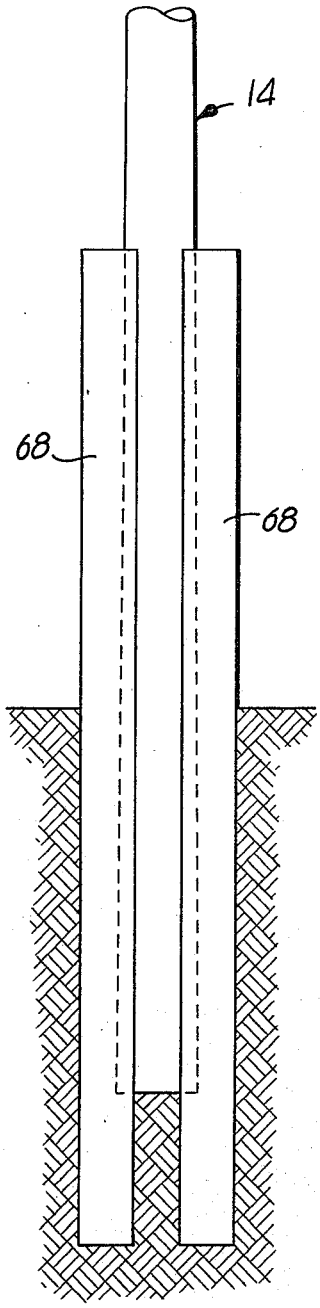
Fig.8.
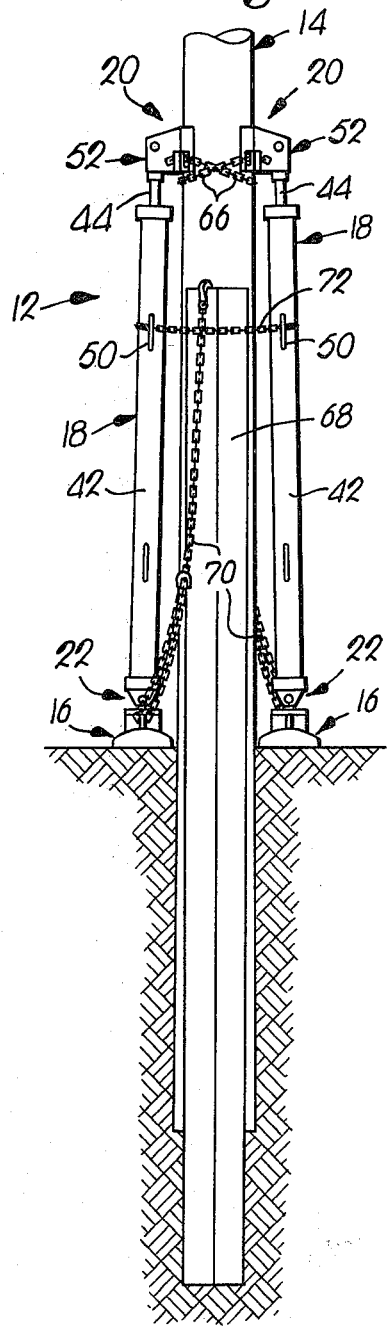

METHOD AND APPARATUS FOR EXTENDING THE HEIGHT OF UTILITY POLES

Raising the height of an upright pole is a task frequently encountered in many fields such as by telephone and electric utility companies. For instance, when an electric distribution system is upgraded such that power lines carry higher voltages, the distance between the ground and electrical lines must be permanently increased. The distance may be increased by methods of replacing or splicing the poles, but those methods are costly and time-consuming.

Some pole pullers presently being marketed use fluid cylinders with somewhat limited stroke capacities to raise the pole. The limited stroke capacities of these previous devices often necessitate time-consuming repetition of attaching, lifting, and detaching the fluid cylinders to and from the pole.

The present invention permits use of relatively long fluid pressure cylinders which extend the height of a pole in a single stroke through displacements somewhat greater than those made possible by previous devices in a single stroke. The extended length of the cylinder also permits placement of the gripping heads above the upper edges of the reinforcements, which are normally on the order of 5 ft. above the ground. Greater stability is provided for the pole during displacement by the pole reinforcements driven into the ground alongside the pole. After the pole is raised to its new, desired elevation, the pole reinforcers are secured to the pole with fasteners, and the elevated pole is greatly stabilized. Such stability could even be provided if the pole were taken entirely out of the ground.

Use of the long, single stroke cylinders for raising poles is also made possible by the provision of special heads pivotally attached to the upper ends of the cylinder rods and clamped to the pole in such a manner that the heads will automatically bite into the pole in response to the force of the lifting action of the cylinders.

Still further, we have found that the time saving method of our present invention can be accomplished by providing each gripper with a chain which is looped about the pole for promoting biting of the gripper edges into the pole during extension of the devices. Additionally, our invention makes possible the use of retainers for prevention of upward displacement of the reinforcers through frictional engagement of the reinforcers with the pole during the ascent of the latter.

In the drawings:

FIG. 1 is a partially schematic side view of apparatus for permanently extending the height of a pole, made in accordance with our present invention, operably associated with a pole showing the pole raised;

FIG. 2 is a fragmentary front view of the apparatus;

FIG. 3 is an enlarged top plan view of one of the pole grippers pivotally secured to the upper end of its extensible power device showing the relationship of the pole thereto;

FIG. 4 is an enlarged, fragmentary cross sectional view taken along line 4—4 of FIG. 2;

FIG. 5 is a cross sectional view taken along line 5—5 of FIG. 11;

FIG. 6 is a view of an upright pole set in the ground prior to raising;

FIG. 7 is a side view of a pole having reinforcements driven into the ground alongside and complemental to the pole;

FIG. 8 is a view similar to FIG. 1, showing the apparatus disposed about the pole prior to the lifting thereof;

Figure 9:
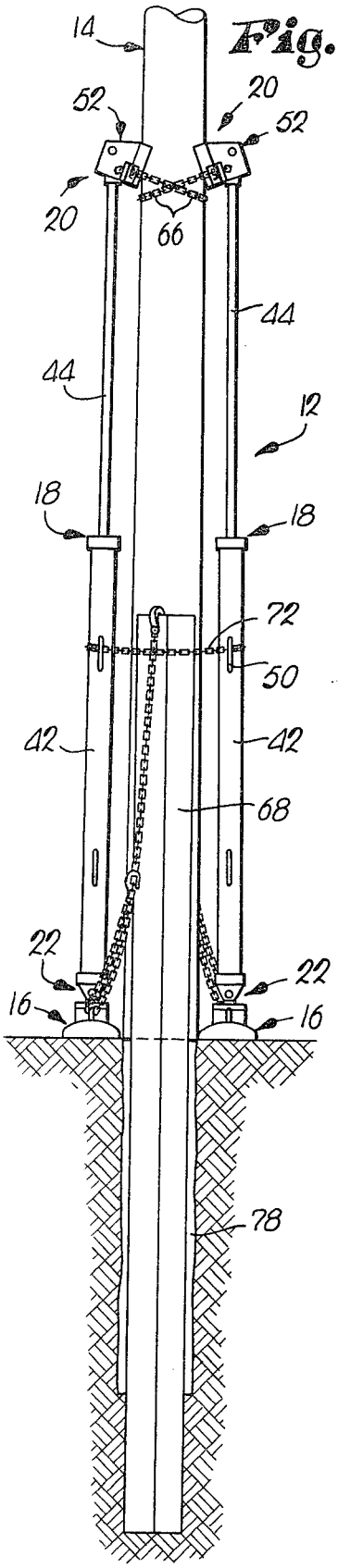
FIG. 9 is a view similar to FIG. 1 with the hydraulic power source removed.

An apparatus 12 for extending the height of an upright pole 14 comprises a number of ground-engaging supports 16 with an extensible power device 18 projecting upwardly from each support 16. A structure 20 is mounted on the upper end of each device 18 for releasably connecting the device with the pole 14. Pivot means 22 couples each device 18 with its support 16 to permit tilting of the devices 18 during extension thereof.

Each of the elongated supports 16 is preferably hollow as seen in FIG. 4 and provided with a longitudinal reinforcement 24 together with a number of transverse reinforcements 26 therewithin, the upper wall 28 of the support 16 being transversely arcuate. Loops 30 are secured to the top surface of the upper wall 28.

A central block 32 rigidly attached to the wall 28 has a semi-spherical cavity 34 which receives a ball 36. The ball 36 is held in place by a perforated plate 38 which may in turn be releasably attached to the upper surface of the block 32. The ball 36 has an upright stem 40 integral therewith.

Each device 18 is in the nature of a fluid pressure piston and cylinder assembly, preferably hydraulic in nature, including, therefore, in each instance, cylinders 42 and a piston rod 44. The lower end of each cylinder 42 has a pair of lugs 46 depending therefrom and receiving the stem 40 therebetween. A cross pin 48 interconnects the stem 40 and the lugs 46. Two more sets of diametrically opposed loops 50 are bound rigidly to each cylinder 42.

Each structure 20 includes a gripping head 52 coupled with the corresponding rod 44 by a pintle 54. The head 52 includes an arcuate plate 56 having a pair of outwardly extending lugs 58 and receiving block 60 on the rod 44 and, therefore, the connecting pintle 54. Each plate 56 has, therefore, an upper arcuate edge 62 conforming substantially with the configuration of the pole 14 capable of biting into the latter.

Each plate 56 is also provided with a pair of spaced outwardly extending hooks 64 adapted to receive the links of a pair of chains 66. As best seen in FIGS. 1 and 8–10, a chain 66 is provided for each head 52 respectively. Each chain 66 is wrapped around the pole 14 to hold the heads 52, and particularly the edges 62 thereof, against the pole 14.

Each pole 14 is provided with a pair of elongated transversely V-shaped reinforcements 68 that are set into the ground alongside and complemental to the pole 14 as shown in FIG. 7. The reinforcements 68 provide a channel into which the pole 14 is guided as the elevation is raised. Added strength is also given to the pole 14 in those instances wherein the pole 14 has deteriorated.

In the use of the pole lifter of our invention, raising of the pole 14 normally tends to raise the reinforcements 68 therewith and such is not to be desired.

Our invention is especially adapted for preventing this adverse effect; thus, the loops 30 are used to receive chains 70 which are hooked, as shown in the drawings, over the upper edges of the reinforcements 68.

In order to stabilize the cylinders 42 before the gripping heads 52 are attached to the pole 14 with the chain 66, stabilizing chains 72 are wrapped around the devices 18, the reinforcements 68, and the pole 14 through the loops 50. The stabilizing chains 72 prevent the devices 18 from falling away from the pole 14 until the chain 66 can be wrapped around the pole 14 and secured in the hooks 64.

During operation the double-acting devices 18 are preferably coupled with a source 74 of hydraulic fluid and, of course, with associated manual control valving within the circuit (not shown).

The initial step is driving reinforcements 68 into the ground alongside and complemental to the pole 14. As shown in FIG. 7, reinforcements 68 should be driven to a depth below the lower end of the pole 14.

The supports 16 are placed on the ground in substantial parallelism alongside the pole 14 and, therefore, the reinforcements 68. The rods 44 are retracted as shown in FIG. 8; and gripping heads 52 are attached above the upper ends of reinforcements 68. The devices 18 are preferably of such length that the rods 44 may be extended through a displacement such that heads 52 may be located above the reinforcers in their operative pole supporting dispositions in the ground regardless of the relative lengths of such reinforcers absent this desirable requisite, it would be necessary to take more than one bite on the pole and support would be required for the hydraulic cylinders at levels above the ground causing not only mechanical complications of cylinder support but also possible force vector dislocations and equipment handling problems.

The chains 70 and the chains 72 are attached in the manner shown in FIG. 8 and the chains 66 are looped around the pole 14 in a substantially snug fit to hold the heads 52 engaged with the pole 14.

Figure 10:
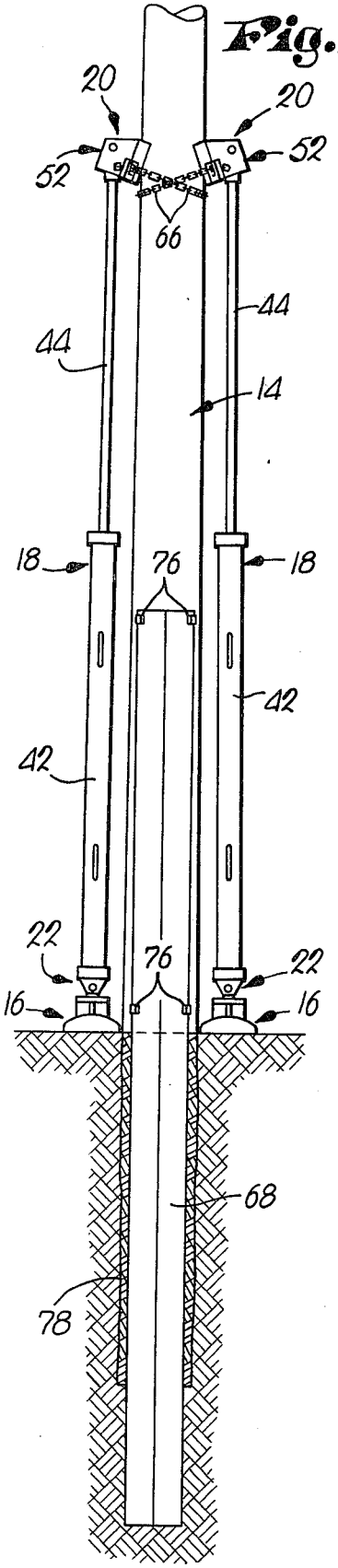
FIG. 10 is a view of the apparatus of FIG. 9 after lifting the pole out of the ground, detaching the reinforcement guard and the stabilizer, and attachment of the pole reinforcement to the pole.

As fluid is directed to the cylinders 42 in a direction to raise the rods 44, by virtue of the pintle 54 the heads 52 tend to tilt in a direction for placing the edges 62 into tight biting engagement with the pole 14. Thus, the pole 14 is raised to a new height in a single long stroke of the cylinders 42 as illustrated in FIGS. 1, 9 and 10. However, as therein illustrated, the reinforcements 68 remain in place and are not raised with the pole 14.

The extraordinarily long nature of the devices 18 results in their being somewhat unstable and perhaps even bendable. As the rods 44 are extended, bending moments of the rods 44 would threaten to damage the devices 18. The mounting best shown in FIG. 4 tends to ameliorate the bending moments that might be communicated to the pole by differential settlement of the ground beneath the supports 16. The fact that the devices 18 can swivel within the ball and socket joint 32–34 alleviates potential damage to the devices 18.

Figure 11:
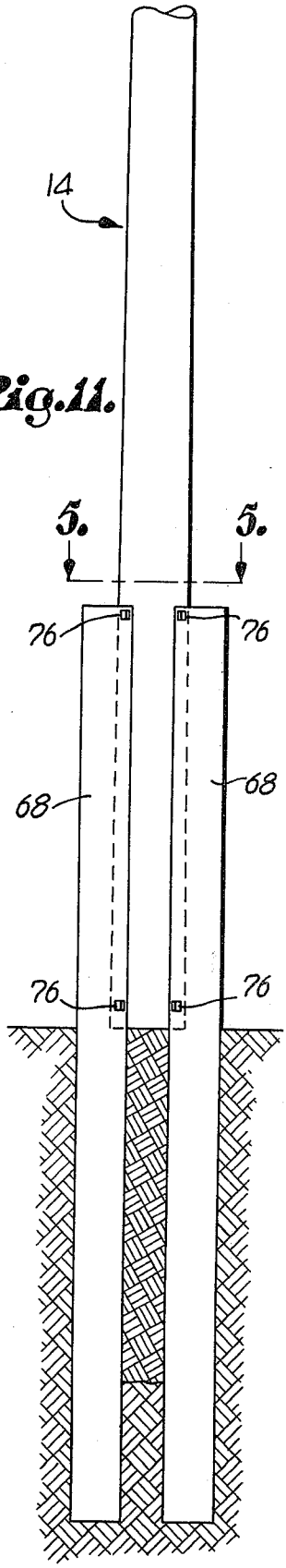
FIG. 11 is a view of the pole supported and stabilized at its new height by the reinforcements after the space left by removal of the pole from the ground has been refilled.

Before removal of the apparatus 12 from the pole 14, a number of fasteners 76 are utilized to attach the reinforcements 68 to the pole 14 as exemplified by FIGS. 5, 10 and 11. The fasteners 76 provide permanent support for the pole 14 at its new height.

Raising the pole 14 leaves a cavity 78 underneath the pole 14, as seen in FIG. 10. The cavity 78 is filled with soil or other suitable material to provide base line support for the pole 14.

One feature of this invention is the fact that it lends itself to upgrading utility lines by increasing the number of insulators for example suspending or supporting conductors carried by conventional wood poles without changing out the poles or even removing the conductors from the poles as they are raised to heights necessary to provide the new requisite conductor to ground clearances. The reinforcers 68 may be driven into the ground, hydraulic devices 42 connected to the pole and actuated to raise the same to a desired level, and the pole thereafter permanently attached to the reinforcers for support thereby, without removing the conductors from the pole. Additional insulators may then be added, all without interruption of electrical power. As an example, for raising a class 1 pole, 13 foot long reinforcers would be used, each leg of which would be about 10 inches wide and the reinforcers would be driven into the ground to a depth of about 7 feet leaving 6 feet of the reinforcers above ground. Connecting bands (usually about 8 would be employed) then would be placed around the reinforcers and pole for permanent support of the latter by the reinforcers.

An additional feature is the fact that all the units break down to a size and weight that can be moved to a utility pole by hand carrying where there is no access for a truck with a pole support thereon or crane.

Using two cylinders tends to pull the pole directly out of the ground in a straight line whereas the use of only one cylinder in accordance with prior practices for pole pulling causes an overturning moment on the pole when force is applied to extract the pole.

We claim:

1. Apparatus for extending the height of an upright pole set in the ground comprising:

elongated pole reinforcers for placement in the ground alongside the pole and complemental thereto;

a number of ground-engaging supports adapted to receive the pole therebetween;

an extensible power device projecting upwardly from each support respectively; and structure mounted on the upper end of each device respectively for releasably connecting the devices with the pole.

2. The invention of claim 1, each support having pivot means coupling each support with its device, permitting shifting of the support in engaging the ground.

3. The invention of claim 2; and a universal joint, separate from said pivot means, coupling each device with its support.

4. The invention of claim 3, each joint including a ball having a stem, each pivot means coupling its device with its stem, each support having a ball-receiving socket.

5. The invention of claim 1, each device comprising a fluid pressure piston and cylinder assembly.

6. The invention of claim 5, each structure including a pole gripper pivotally secured to the upper end of the corresponding assembly, each gripper having a releasable element for holding the same in gripping relationship to the pole.

7. The invention of claim 6, each gripper having means for biting into the pole as the assemblies are extended.

8. The invention of claim 7, each element being flexible and adapted to be looped around the pole.

9. The invention of claim 1, each pole reinforcer having means for securing the reinforcer to the pole.

10. The invention of claim 9, each pole reinforcer having means preventing upward displacement of the reinforcer as the pole is raised.

11. Apparatus for extending the height of an upright pole set in the ground comprising:

a pair of elongated pole reinforcers for placement in the ground on opposite sides of the pole and complemental thereto, each reinforcer having means for securing the reinforcer to the pole;

a pair of upright, fluid pressure piston and cylinder assemblies adapted to receive the pole therebetween.

each assembly having a cylinder and a piston rod extensible upwardly from the upper end of its cylinder, each cylinder having a ground-engaging support therebeneath, each rod having a pole gripper pivotally attached to its upper end, each gripper having a pole biting edge and a chain adapted to be looped around the pole for holding its edge into biting relationship to the pole as the rods are extended.

12. The method of extending the height of an upright pole set in the ground through use of a number of elongated power devices, each having a member extensible upwardly therefrom, said method including the steps of:

driving pole reinforcers into the ground alongside the pole and complemental thereto;

setting the devices on the ground in an upright position alongside the pole;

attaching the upper ends of the members to the pole;

gripping the pole at the zone of attachment of the members thereto while extending the members;

extending the height of the pole using the pole reinforcers as guides during extension of the height of the pole;

securing the pole reinforcers to the pole to stabilize the pole at its elevated height.

13. The method of claim 12; and biting into said pole at said zone during extension of the members.

14. The method of claim 13 wherein each gripper has a chain which is looped about the pole for promoting said biting.

15. The method of claim 12 wherein the supports are set on the ground for shifting movement in engaging the ground.

16. The method of claim 12 wherein the pole reinforcers are maintained at a constant height such that elevation of the pole does not cause ascent of the reinforcers.

17. The method of claim 16 wherein said constant height is maintained by detachably connecting a chain between said support and the top of the pole reinforcer.

18. A method of extending the height of a utility pole supporting overhead conductors comprising the steps of:

driving pole reinforcers into the ground alongside and in disposition preventing tilting of the pole as it is raised;

gripping the pole on opposite sides thereof above the level of the pole reinforcers;

exerting substantially continuous upwardly directed forces on the pole at the points of gripping thereof to raise the pole while the conductors remain supported thereby; and fastening the pole to said reinforcers after the pole has been raised to a predetermined new level relative to the ground.

19. A method as set forth in claim 18 wherein is included the steps of initially driving reinforcers into the ground until the lower edges thereof are a level at least as low as the bottom of the pole, and then raising the pole to a height with the bottom thereof substantially at ground level.

20. A method as set forth in claim 19 wherein is included the step of driving the reinforcers into the ground to an extent that the length thereof in the ground is approximately equal to the stretch of the same above ground.

* * * * *